United States Patent [19]

Hemphill et al.

[11] Patent Number: 4,580,386

[45] Date of Patent: Apr. 8, 1986

[54] EXPANSION CLIP ON A CEILING RUNNER

[75] Inventors: John M. Hemphill, Lancaster; Ernest B. Nute, Jr., Mountville; Daniel C. Ziegler, Millersville, all of Pa.

[73] Assignee: Armstrong World Industries, Inc., Lancaster, Pa.

[21] Appl. No.: 330,221

[22] Filed: Dec. 14, 1981

[51] Int. Cl.[4] ..... E04B 5/52; E04B 1/19

[52] U.S. Cl. ..... 52/664; 52/488; 52/573; 52/665; 403/346

[58] Field of Search ..... 52/664, 665, 488, 573, 52/656; 403/346, 347, 189, 246

[56] References Cited

U.S. PATENT DOCUMENTS

| | | | |
|---|---|---|---|
| 2,351,127 | 6/1944 | Hodson | 403/346 X |
| 3,175,655 | 3/1965 | Brown | 52/573 |
| 3,294,428 | 12/1966 | Lickliter | 52/573 |
| 3,722,933 | 3/1973 | Nute | 52/664 X |
| 3,898,782 | 8/1975 | Donato | 52/664 X |
| 4,011,707 | 3/1977 | Nute | 52/664 |

*Primary Examiner*—Donald G. Kelly
*Assistant Examiner*—Kathryn Ford

[57] ABSTRACT

The invention provides a slot in the runner and lugs on a clip to allow sliding contact between the runner and the clip. This allows for expansion of the runner during a fire condition. The clip is fastened to the vertical web of an adjacent runner to fasten the runner structures together. Normally, a clip is provided on each end of one runner structure and it is mounted between two rigidly positioned other runner structures and the runner with the clips is capable of expansion and contraction under fire conditions without buckling.

4 Claims, 1 Drawing Figure

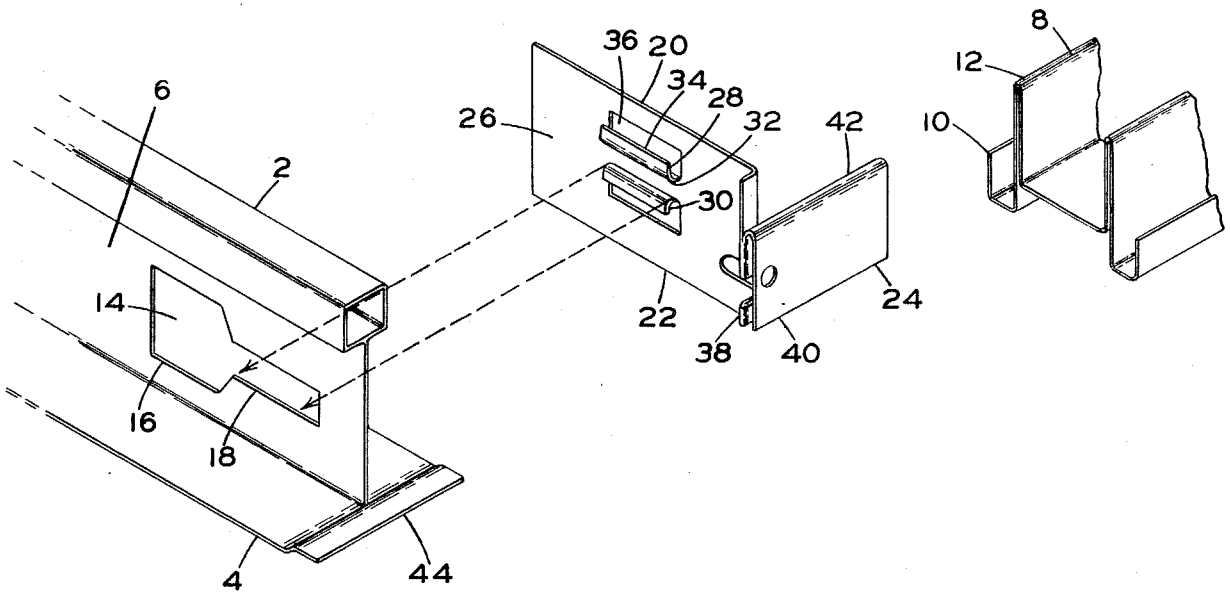
8
12
10
24
42
40
32
28
34
20
36
30
38
22
26
44
2
6
18
14
16
4

EXPANSION CLIP ON A CEILING RUNNER

BACKGROUND OF THE INVENTION

1. Field of the Invention

The invention is directed to a runner structure for a suspended ceiling system and, more particularly, to the clip connecting the ends of the runner structure to adjacent runners.

2. Description of the Prior Art

U.S. Pat. No. 3,396,997 discloses a ceiling grid system with cross grid members that are joined to the main grid member by tabs that are permitted to penetrate further into the main grid members to prevent buckling of the cross grid members in case of fire.

U.S. Pat. No. 3,390,503 discloses a thermally responsive beam joint consisting of a connector portion 26 and a deformable stop 27. As cross beam 20 expands, the stop deforms allowing the connector to ride up on the lower edge of aperture 13. This causes the cross beam to be lifted over the edge of the main beam.

U.S. Pat. No. 3,807,111 discloses a runner joint with means for relieving stress on runners due to their expansion under heat. Main runner 10 has space slots for receiving locking tongues of a perpendicularly extending cross runner. The slots permit the cross runner to expand through the main runner to take up stress developed during heat application.

SUMMARY OF THE INVENTION

The invention is directed to a runner for a suspended ceiling system. The runner is of an inverted T-shape having both ends of the runner with the same configuration. The configuration on the end of the runner is in the form of an elongated slot. A connecting member, which is a clip, has a two-part structure with one part being disposed at a 90° angular relationship to the other part. One part has a means for engaging said elongated slot of the runner and said clip is freely slidable in said slot. The other part of the connecting member has a means for engaging the vertical web of a second runner which is disposed at a 90° angular relationship to said first mentioned runner. Clips are used on both ends of the runner structure and the runner structure is capable of freely expanding and contracting without buckling and without applying stress to the two runner structures that are disposed at a right angle relationship to the ends of the runner with the clips.

BRIEF DESCRIPTION OF THE DRAWING

The drawing is a perspective view in the exploded manner of the three parts involved in the invention herein.

DESCRIPTION OF THE PREFERRED EMBODIMENT

The invention herein is designed to be used with a runner structure 2 for a suspended ceiling. The runner structure is of inverted T-shape with horizontal flanges 4 and the vertical web 6. The runner structure is normally referred to as a cross-runner and it extends between two adjacent parallel main runners. The runner 2 normally supports the edge of ceiling boards which are supported between two parallel main runner structures. A typical main runner structure is shown as runner 8. Runner 8 can be a conventional inverted T-shaped runner or could be the H-shaped runner structure shown in the drawing. The runner shown in the drawing is the conventional C60 grid structure being produced and sold by Armstrong World Industries. The ceiling boards will rest on the edges or flanges 10 and element 12 in effect forms a vertical web. Two runners 8 will be placed in a parallel side by side relationship with approximately 5′ between the two runners. The cross runner 2 will then extend perpendicular to the two runners 8 and will support an edge of a board resting on the flanges 10 of two adjacent runners 8.

A suspended ceiling must meet certain fire resistant tests. Under fire conditions the main runners will expand due to the heat and the subject of overcoming their expansion is not part of this invention. The invention herein is directed to the preventing of the expansion of runner 2, and the contraction of runner 2 after expansion, from springing apart or pushing apart two parallel runners 8 or from buckling runner 2. Expansion of runner 2 might push apart the two runners 8 and cause the ceiling board to drop off the flanges 10 of the runners 8. This is undesirable during a fire test and during fire conditions for a suspended ceiling. It is also possible that the runners 8 will not be pushed apart but would be held rigidly in position and therefore expansion of runner 2 will cause this runner to buckle and possibly cause ceiling boards to drop out of position. Now once the heat is removed from the runner the runner will contract. During the contraction stage with some fire expansion joints, it is then possible that the runner will apply further stresses to a ceiling system. Herein is described an invention which will permit a cross runner to freely expand and contract without affecting the parallel relationship of main runners 8 or the structural integrity of runner 2.

On each end of the runner 2 there is provided an elongated slot 14. The slot has an enlarged end 16 and a narrow portion 18. A connecting member 20 is used to fasten together runner 2 and runner 8. The connecting member 20 has two portions 22 and 24 and these portions are disposed at a 90° angular relationship to each other. The one part 22 has a means 26 for engaging the elongated slot of the runner 2. This means 26 is in the form of two right angle lugs 28 and 30. Each individual lug has a first part 32 which is perpendicular to the part 26 and then a second part 34 which is parallel to the part 26 and forms between the parts 26 and 34 a channel 36. Each lug forms a channel 36 and the channels 36 of the two opposite lugs are disposed facing away from each other. The enlarged end 16 of the enlongated slot 14 is of a sufficient width from top to bottom of the slot that the lugs may be passed through the enlarged opening 14 so that part 26 is up against the vertical web 6 and the part 26 is on one side of the vertical web and the parts 34 are on the other side of the vertical web with the edges on top and bottom of the elongated slot disposed above the channels 36. By sliding the clip or connecting member towards the end of the runner 2, the clip moves adjacent the narrow portion 18 of the elongated slot and now the top and bottom sides of the narrow elongated slot are disposed in the channels 36 and this locks together the clip 20 and the runner 2. The two parts are slideably engaged at this time so that the parts are held together but may slide relative to each other with the clip sliding back and forth along the axis of the runner 2. Naturally in use the slot 18 must be of sufficient length to keep the clip 20 engaged therein when the runner is in use and the enlarged opening 16 is only used to assemble the runner and clip. The clip 20 will not move back to the enlarged opening 16 when the assembly is in use, otherwise the structure could possibly fall apart.

The clip or connecting member 20 is provided with a second part 24 which is disposed at a 90° angular relationship to part 20. This part 24 is composed of a generally inverted U-shaped cross section having two parallel sides 38 and 40 connected together at their top 42. This structure 24 slips over the vertical web 12 of runner 8 and holds the clip to the web 12. This structure is positioned so that when the part 24 is engaging the web 12 the horizontal flange 44 of runner 2 is resting on the flange 10 of runner 8. Part 24 is frictionally held on web 12 of runner 8 and will not slide thereon normally. Some type of mechanical structure, i.e. wire clips, could also more positively hold the clip to runner 8.

With connecting members or clips 20 on both ends of runner 2, the ends of runner 2 will be fastened to two adjacent main runners 8 and the runner 2 will be able to slide back and forth slightly between the two runner structures 8. Consequently, with the application of heat the runner 2 can expand because the edge of the runner 44 is normally spaced at least $\frac{1}{8}''$ from the vertical web 12 of runner 8. Consequently, on a 5′ section of cross runner 2 there is the provision for at least $\frac{1}{4}''$ of expansion of the runner before the edges 44 could possibly engage the vertical web 12 on both ends of the cross runner 2. With the removal of heat the cross runner can contract and due to the elongated slot structure will resume its normal shape without applying any pulling stress to runners 2 or 8.

What is claimed is:

1. A runner for a suspended ceiling system comprising:

(a) a runner of inverted T-shape having both ends formed with the same configuration, (b) the configuration on the ends of the runner being an elongated slot, (c) a connecting member having a two-part structure with one part being disposed at a 90° angular relationship to the other part, (d) said one part having a means for engaging said elongated slot of said runner and being freely slidable in said slot, (e) the other part of said connecting member having a means for engaging the vertical web of a second runner which is disposed at a 90° angular relationship to said first mentioned runner, (f) said connecting member being on both ends of said runner, and (g) said elongated slot has an enlarged end into which said engaging member on said connecting member is inserted whereby subsequential sliding movement of said engaging means into the narrow portion of the elongated slot will lock together said runner and connecting means.

2. The runner of claim 1 wherein said engaging means is formed of two right angle lugs disposed facing away from each other, each lug has a first part perpendicular to the body of said connecting member and on the end thereof a second part parallel with the body of said connecting member to define a channel therebetween, said channel being between the body of said connecting member and said second part.

3. The runner as set forth in claim 2 wherein said enlarged end of said elongated slot is wide enough to receive the lugs of the connecting member whereby the edges of said slot are disposed above said lug channels, with the other portion of the elongated slot being of a width less than the enlarged end so that the edges of said slot in its narrow region fit into said channels to hold the connecting member to the runner, but permit sliding of the connecting member on the runner.

4. The runner of claim 3 wherein said means for engaging the vertical web of a second runner is an inverted U-shape structure that laps over the top of the vertical web and is frictionally held thereto.

* * * * *